US006814268B2

(12) United States Patent
Rothfuss et al.

(10) Patent No.: US 6,814,268 B2
(45) Date of Patent: Nov. 9, 2004

(54) CRACK RESISTANT VALVE PLATE FOR A SLIDE GATE VALVE

(75) Inventors: Hans K. Rothfuss, Taunusstein (DE); Vincent Boisdequin, Naast (BE)

(73) Assignee: Vesuvius Crucible Company, Wilmington, DE (US)

( * ) Notice: Subject to any disclaimer, the term of this patent is extended or adjusted under 35 U.S.C. 154(b) by 182 days.

(21) Appl. No.: 10/149,563

(22) PCT Filed: Dec. 5, 2000

(86) PCT No.: PCT/BE00/00144

§ 371 (c)(1),
(2), (4) Date: Jun. 10, 2002

(87) PCT Pub. No.: WO01/41956

PCT Pub. Date: Jun. 14, 2001

(65) Prior Publication Data

US 2002/0189676 A1 Dec. 19, 2002

(30) Foreign Application Priority Data

Dec. 10, 1999 (EP) ..... 99870258

(51) Int. Cl.[7] ..... B22D 41/08
(52) U.S. Cl. ..... 222/600; 222/597

(58) Field of Search ..... 222/600, 597; 266/236

(56) References Cited

U.S. PATENT DOCUMENTS

| | | | | |
|---|---|---|---|---|
| 4,508,241 A | | 4/1985 | Bauer et al. | |
| 4,728,013 A | | 3/1988 | Winkelmann et al. | |
| 5,626,164 A | | 5/1997 | Richard et al. | |
| 5,730,892 A | | 3/1998 | Niwa et al. | |
| 6,092,701 A | * | 7/2000 | Waltenspuhl et al. | 222/600 |

FOREIGN PATENT DOCUMENTS

| | | |
|---|---|---|
| DE | 3432613 C1 | 9/1984 |
| DE | 3522134 A1 | 6/1985 |
| DE | 19531353 A1 | 8/1995 |
| WO | WO 98 05451 A 1 | 2/1998 |

* cited by examiner

*Primary Examiner*—Scott Kastler
(74) *Attorney, Agent, or Firm*—James R. Williams; Robert S. Klemz, Jr.

(57) ABSTRACT

The invention relates to a refractory plate (1) for a slide gate valve, having a pouring hole (3), circumscribed by a circle C of center (4), at least a portion of the edges (15, 16, 17, 18) of the plate (1) are angularly oriented so as to focus the clamping forces optimally in the throttling area and around the pouring hole.

9 Claims, 1 Drawing Sheet

CRACK RESISTANT VALVE PLATE FOR A SLIDE GATE VALVE

FIELD OF THE INVENTION

This invention generally relates to valve plates for use in slide gate valves for controlling a flow of molten metal, and is specifically concerned with a valve plate that is resistant to cracks caused from thermomechanical stresses.

BACKGROUND OF THE INVENTION

Slide gate valves are commonly used to control a flow of molten metal in steel making and other metallurgical processes. Such valves generally comprise a support frame, an upper stationary valve plate having an orifice in registry with a tundish or ladle nozzle for conducting a flow of molten metal, and a throttle plate likewise having a metal conducting orifice that is slidably movable under the stationary valve plate. In slide gate valves used in conjunction with continuous casting molds, a lower stationary valve plate is provided beneath the movable throttle plate which likewise has a flow conducting orifice that is substantially aligned with the orifice of the upper stationary plate. The rate of flow of molten metal is dependent upon the degree of overlap of the orifice of the slidably movable throttle plate with the orifice of the upper stationary plate. The movable throttle plate is usually longer than the stationary throttle plate in order to give it the capacity of throttling the flow of molten metal from both the front and back edges of its own orifice, as well as the ability to shut off the flow altogether by bringing its orifice completely outside of any overlap with the orifices of the stationary plate. Typically, the throttle plate is slidably manipulated between the stationary plates by means of a hydraulic linkage.

The throttle plate and the stationary plate are mounted in respectively a lower indentation and an upper indentation, each of these plates resting in an indentation through a surface that becomes its support surface and cooperating with the other plate through a surface that becomes its sliding or working surface.

Both the throttle plate and the stationary plates of such slide gate valves are formed from heat and erosion resistance refractory materials, such as aluminum oxide, alumina-carbon, zirconium oxide. However, despite the heat and erosion resistance of such refractory materials, the severe thermomechanical stresses that they are subjected to ultimately cause some degree of cracking to occur. For example, in steel making, each valve plate is subjected to temperatures of approximately 1600° C. in the area immediately surrounding its flow-conducting orifice, while its exterior edges are experiencing only ambient temperature. The resulting large thermal gradient creates large amounts of thermomechanical stress as the area of each plate immediately surrounding its orifice expands at a substantially greater rate than the balance of the plate. These stresses cause cracks to form which radiate outwardly from the orifice of the plate. If nothing is done to contain the spread of these cracks, they can extend all the way to the outer edges of the plate, causing it to break.

To prevent the spreading of such cracks and the consequent breakage of the valve plates, various solutions have been developed in the prior art. In a first attempt, improved clamping mechanisms have been designed. The purpose of these mechanisms is to apply sufficient pressure around the perimeter of the plate so that cracks emanating from the orifice do not spread to the edges of the plate. One such mechanism comprises a frame having screw-operated wedges which engage corners of the plate that have been truncated in an angle that is complementary to the angle of the wedges. Such a system is disclosed in the document DE-C2-3,522,134. While such frame and wedge-type clamping mechanisms constitute an advance, the inventors have noted some shortcomings with this design that prevent it from achieving its full, crack-retarding potential. Generally, the clamping forces are not uniformly focused where the maximum amount of cracking occurs, i.e., in the vicinity of the orifice where the greatest amount of thermomechanical stresses are present. Moreover, the applicants have observed that, generally, the angular orientation of the truncated corners in such plates does not optimally prevent the spreading of cracks, as previously thought. Such non-optimality results from the fact that crack formation is not uniformly distributed 360° around the orifice, but instead is biased along the longitudinal center line of all valve plates whether stationary or movable. Such an asymmetrical distribution of cracks around the plate orifices is believed to occur as a result of the longitudinal sliding action of the throttle plate across the faces of the stationary plates.

U.S. Pat. No. 5,626,164 discloses a crack resistant valve plate; the shape of said plate being designed to prevent the formation and spreading of cracks therein. This plate has an axis, and an orifice for conducting molten metal that is positioned along said axis, and truncated corners for focusing a clamping force toward said axis in the vicinity of said orifice, wherein each of said truncated corners is orthogonal to a line extending between a tangent point to said orifice, across said axis, and through an intersection of lines drawn parallel to converging plate edges that are spaced from said edges a distance equal to one-half of a width of said orifice.

In the document WO-A1-98/05451, there is disclosed a variant of this solution wherein the angles between the lateral faces of the plate are defined so as to extend the lifetime of the plate.

While U.S. Pat. No. 5,626,164 constitutes already a markedly clear advance over the previously known solution, applicants have tried to still optimize the plate shape. Clearly, there is a need for a valve plate whose shape optimally focus the clamping forces in the most crack-prone areas of the plate in order to maximally retard the lengthening of any such cracks. Ideally, the corners should have a length sufficient to avoid the production of unwanted localized mechanical stresses in the corners.

FIG. 2 of the document DE-A1-195 31 353 discloses a slide gate plate according to the preamble of claim 1. The edges, which are the closest to the pouring hole, are slightly inclined with respect to the rectangle elongation direction. It has been determined that with such an orientation of the edges, high tensile stress will develop around the pouring hole and could, in use, result in cracks radiating from the orifice towards the plate sides parallel to the rectangle elongation direction.

SUMMARY OF THE INVENTION

Generally speaking, the invention is a crack resistant valve plate assembly for use in a slide gate valve that overcomes or at least ameliorates the disadvantages associated with the prior art or that at least equals the performance of the plate disclosed in U.S. Pat. No. 5,626,164.

The invention relates thus to a refractory plate for a slide gate valve which may be circumscribed by an elongated rectangle R having two sides parallel to the direction of its elongation. The rectangle R has a longitudinal axis, which is defined as its longest symmetry axis and which will coincide with the preferential sliding trajectory of the plate. It is however to be clearly understood that this concept of preferential sliding trajectory is an intrinsic characteristic of the plate according to the invention and that this plate may be slid in a gate valve according to a direction which is not the optimal or preferential one.

The Plate has an orifice, that is, the pouring hole, for conducting molten metal. Most often said orifice is circular, more generally, it is circumscribed by a circle C of diameter □. The orifice is positioned eccentrically in the middle between the parallel sides of the rectangle R.

For construction purpose, the rectangle R is divided into four quadrants by two perpendicular lines intersecting at the center of the circle C, one of these lines extending in the middle between the parallel sides of the rectangle R. Each quadrant has intersecting diagonals: diagonals D1, D3, D5, D7 joining the center of the circle C to the corners of the rectangle R and diagonals D2, D4, D6 and D8 joining adjacent intersections of the perpendicular lines intersecting at the center of the circle C with the sides of the rectangle R.

The pouring hole is offset along the longitudinal axis so that throttling may be effected on a longer area. The pouring hole may also be slightly offset along an axis perpendicular to the longitudinal axis.

The plate has angularly oriented edges, figuring the truncated corners of the rectangle R, for focusing clamping forces toward the vicinity of the orifice and toward the throttling area to prevent the formation and spreading of cracks therein.

According to the invention, at least a portion of the edges are defined as follows:

a) the edges farthest from the pouring hole (thus, closest to the throttling area) deviate at maximum 5° from the direction of the diagonals which do not intersect the respective corner; and b) the edges closest to the pouring hole (thus farthest from the throttling area) deviate at maximum 5° from one of the following direction (i) the direction perpendicular to the diagonal intersecting the respective corner;

(ii) the direction of the other diagonal of the respective quadrant; or (iii) a direction intermediate between the directions (i) and (ii).

Applicants have indeed determined that such a plate shape focus optimally the clamping force to two different areas of the plate. On the one hand, the throttling area is kept in compression, preventing thus the apparition of cracks in that region and on the other hand, the perimeter of the pouring hole is also kept in compression, preventing thus the spreading of cracks radiating from the pouring hole.

Applicants have observed that the newly designed plate is extremely advantageous. Firstly, far less cracks are observed. Secondly, even if they still occur, the cracks do not spread up to the plate edges, so that air ingression is markedly reduced. And thirdly, when the plate according to the invention is used in combination with an appropriate clamping device, the cracks, if any, only occur in acceptable area, that is, they do not occur in the throttling area or directly in the area between the pouring hole and the closest edges.

The plate may be symmetrical with respect to its longitudinal axis, but in the preferred embodiment, the plate is not symmetrical with respect to the longitudinal axis. Because of this asymmetry, the plate may only be mounted in one position in the upper indentation and in one position in the lower indentation so that the support surface of the plate becomes its sliding or working surface when the plate passes from one position to the other in case recycling of the plates is desirable.

The plate may have only four edges defined as above, but in order to avoid sharp angles, it may have more edges. In such a case, the supplemental edges may (or not) be parallel and/or perpendicular to the longitudinal axis.

It must be understood that according to the present invention, it is not mandatory that the plate be polygonal. On the contrary, in case a clamping band is used around the plate, such clamping band can apply localized mechanical stresses, which could turn into cracks, to the vertex defined by adjacent edges. Therefore, it is advantageous that the corner be rounded.

In the preferred embodiment, only a portions of the edges satisfy the above definition. More preferably, the balance of the edges are comprised of curves joining the said edges portions and most preferably of transition radius of the said edges.

DETAILED DESCRIPTION OF THE INVENTION

Figure 1:
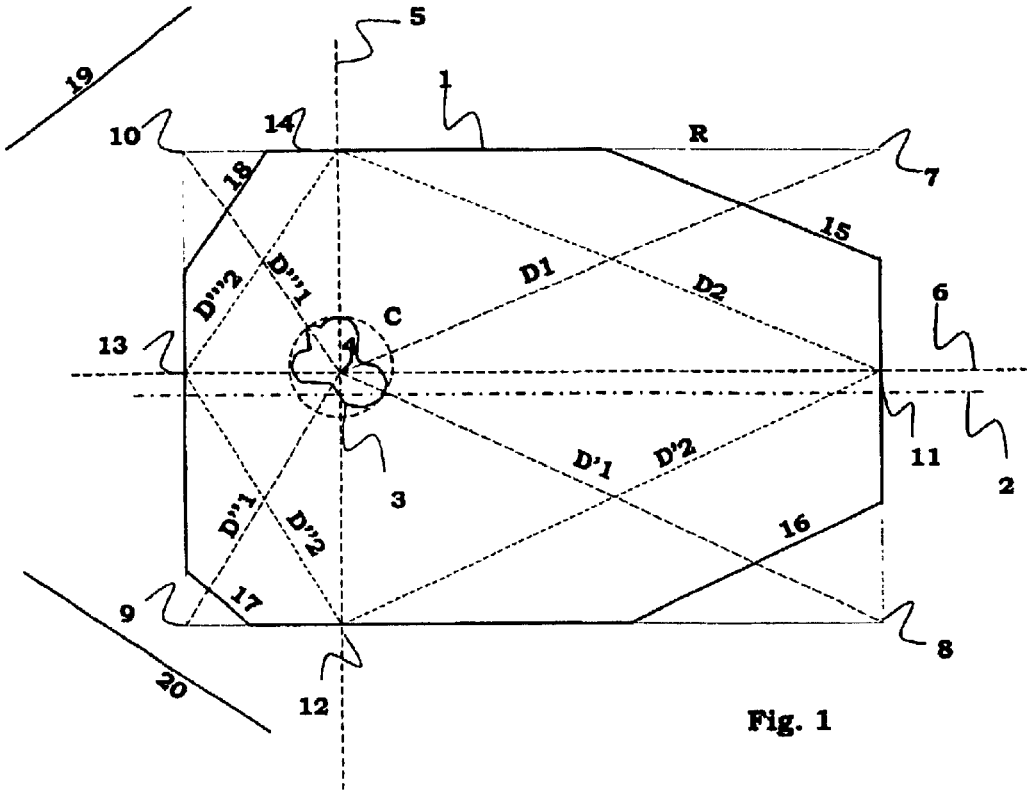
FIGS. 1 and 2 are top plan views of plates of the invention.

With reference now to FIG. 1, wherein like numbers designate like components throughout the figures, the invention relates to a valve plate 1 for use in a slide gate valve of the type used to regulate a flow of molten steel or other metal from a tundish to a mold or from a ladle to a tundish.

The plate 1 has an orifice 3 for pouring the molten metal stream. Said pouring hole 3 is circumscribed by a circle C of center 4. FIG. 1 illustrates a plate with a non circular pouring hole and FIG. 2 shows a plate with a pouring hole 3 corresponding to the circle C.

Figure 2:
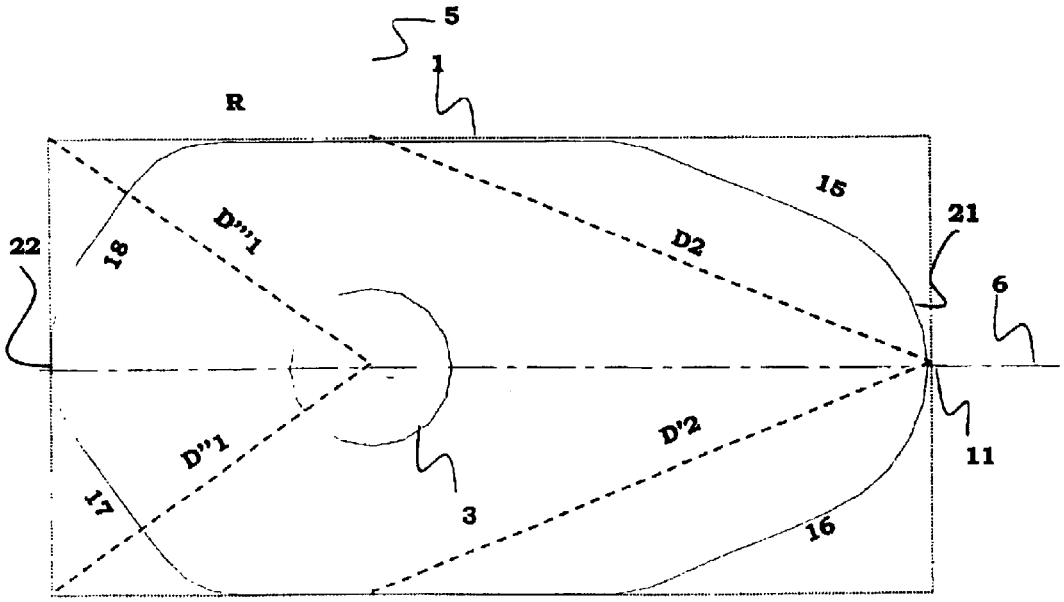

Rectangle R is visible on FIGS. 1 and 2. Rectangle R circumscribes plate 1 and has its longest sides parallel to the sliding trajectory of the plate in the slide gate valve. For construction purpose, it is necessary to draw two perpendicular lines 5 and 6 which cross at the center 4 of the circle C and which are parallel to the short and long sides of the rectangle R. These lines define thus four quadrants of the rectangle R. Each quadrant has intersecting diagonals: D1, D3, D5 and D7 joining the center 4 of the circle C to the four corners (7, 8, 9, 10) of the rectangle R and D2, D4, D6 and D8 joining adjacent intersections (11, 12, 13, 14) of the lines 5 and 6 with the sides of the rectangle R.

According to the invention, the edges of the plate specially designed to focus the clamping forces in the throttling area, that is, the edges 15 and 16 that are the farthest from the pouring hole 3 and thus closest to the throttling area, have at least a portion (against which the clamping force will be applied) that is parallel to the diagonal D2 or D4 of the quadrant containing said edge.

On both FIGS. 1 and 2, at least a portion of the edge 15 is parallel to the diagonal D2 and at least a portion of the edge 16 is parallel to the diagonal D4. On FIG. 1, the entire edges 15 and 16 are parallel to the diagonals D2 and D4 while on FIG. 2, only a portion of the edges 15 and 16 is parallel to the diagonals D2 and D4.

The edges of the plate which are specifically designed to focus the clamping forces around the pouring hole 3, i.e. the edges 17 and 18 which are the closest from the pouring hole 3 may be shaped perpendicular to the diagonals D5 or D7 of the quadrant containing said edge or, in other words, parallel to a direction 19 or 20 defined as a perpendicular to the diagonals D5 or D7. This embodiment is illustrated on both edges 17 and 18 of FIG. 2 which are respectively perpendicular to diagonals D5 or D7.

Alternatively, these edges 17 and 18 may be shaped parallel to the diagonals D6 or D8 of the quadrant containing them as is illustrated on edges 17 and 18 of FIG. 1, which are parallel to diagonals D6 or D8. In another variant, the edges 17 and 18 may be oriented in a direction comprised between the two above defined directions.

The edges 15, 16, 17 and 18 may contact each other, defining thus a tetragonal plate 1, defined by the joint diagonals D2, D4, D6 and D8. Obviously, to avoid mechanical stresses, it is preferred to avoid such tip-shaped corners. Therefore, preferably, the edges 15, 16, 17 and 18 do not contact directly. They may be separated by straight lines, preferably parallel to the sides of the rectangle as illustrated on FIG. 1. Even more preferably, they are separated by transition curves. On FIG. 2, edges 15 and 16 and edges 17 and 18 are joined by transition radii 21 and 22.

According to the invention, the essential parameter is the orientation of the edges 15, 16, 17 and 18, which will determine the way they focus the clamping forces to avoid the cracks. Their position with respect to the pouring hole 3, i.e. the position of the edges 15, 16, 17 and 18 along the respective diagonals D1, D3, D5 and D7 is less important for that criterion. However, it is preferable that the edges 15, 16, 17 and 18 are not too long to avoid the mechanical stresses due to the tip-shaped corners, nor too short for efficiently focusing the clamping forces where it is necessary.

Therefore, the edges which are closest to the throttling area, that is, edges 15 and 16 (or their projections), should preferably cut the short side of the rectangle R in a region comprised respectively between ⅛ and ⅜ and between ⅝ and ⅞ of the length of the short side of the rectangle R.

This requirement is less important on the other side of the plate (i.e. the side where the edges are closest to the pouring hole), so that edges 17 and 18 (or their projection) should preferably cut the short side of the rectangle R in a region comprised between 1/10 and 9/10 of the length of the short side of the rectangle R.

To determine whether a plate is or is not designed according to the invention, it is necessary to build the rectangle R circumscribing the plate. If the plate is not regular, which is generally the case, an infinite number of rectangles may circumscribe the plate. However, there is only one rectangle R circumscribing the plate and having edges parallel to the preferential trajectory of the plate. The preferential trajectory of the plate may be found easily. Indeed, according to the above defined construction rule for the plate, one knows that, on the farthest side from the pouring hole, at least a portion of the edges 15, 16 of the plate 1 must be parallel to the diagonal D2 or D4 of a quadrant of the rectangle R.

Therefore, if these edges portions are prolonged until they cross, a sector is defined having a vertex which is the intersection of the prolonged edges 15 and 16. This sector is similar to the sector defined by the diagonals D2 and D4 and their vertex 11. On the other hand there is at least one (but often an infinite number of) pair of parallel lines (E1, E2), wherein one (E1) comprises the center 4 of the circle C circumscribing the pouring hole 3 and the other (E2) is tangent to an edge of the plate which is far from the pouring hole 3. For each pair of parallel lines (E1, E2), there is only one line (E3) that is perpendicular to both parallel lines E1 and E2 and which comprises the center 4 of the circle C circumscribing the pouring hole 3. Finally, there is only one of these lines (E1, E2, E3) combinations such that E1 and E3 coincide with the perpendicular lines 5 and 6 used for the construction of the plate.

Consequently, if the vertex of the above defined sector is brought (by translation) on the intersection of the perpendicular lines E2 and E3, there is only one possible orientation of these lines (E2 and E3) such that the lines generating the above defined sector coincide with the diagonals D2 and D4 and such that the intersection of lines E2 and E3 coincides with the vertex 11. Pursuant to the constructions rule, the intersections of the diagonals D2 and D4 with the line E1 (which coincides thus with the line 5) shall be at the border of the plate or out of the plate, but never in the plate. This orientation being found, it is easy to draw the rectangle R having sides parallel to the lines 5 and 6 (or E1 and E2).

What is claimed is:

1. A refractory plate for a slide gate valve, comprising a shape circumscribed by a rectangle having two elongated sides, a farthest shortened sides, and a closest shortened side; the shape defining a pouring hole positioned substantially midway between the elongated sides and closer to the closest shortened side than to the farthest shortened side; the pouring bole circumscribed by a circle having a center; the rectangle having four quadrants defined by a first perpendicular line parallel to the elongated sides, a second perpendicular line parallel to the shortened sides, the first and second perpendicular lines intersecting at the center of the circle; each quadrant having a first diagonal intersecting the center and a second diagonal; the shape comprising at least two farthest inclined edges and two closest inclined edges, at least a portion of the farthest inclined edge of a quadrant no more than 5° off parallel from the second diagonal, and at least a portion of the closest inclined edge in a quadrant no more than 5° off parallel from a direction ranging from the second diagonal and a perpendicular to the first diagonal.

2. The refractory plate of claim 1, wherein each shortened side has a length, the farthest inclined edges include geometric projections of the farthest inclined edges, and the farthest inclined edges intersect the farthest shortened side between ⅛ and ⅜ and between ⅝ and ⅞ of the length.

3. The refractory plate of claim 1, wherein the closest inclined edges include geometric projections of the closest inclined edges, and the closest inclined edges intersect the closest shortened side between 1/10 and 9/10 of the length.

4. The refractory plate of claim 1, wherein the farthest inclined edges are connected by a first transition curve.

5. The refractory plate of claim 4, wherein a first transition radius defines the transition curve.

6. The refractory plate of claim 1, wherein the closest inclined edges are connected by a second transition curve.

7. The refractory plate of claim 6, wherein a second transition radius defines the second transition curve.

8. The refractory plate of claim 1, wherein the shape is asymmetrical along the elongated sides.

9. A sliding gate valve adapted to received a refractory plate as described in claim 1.

* * * * *